US006325368B1

(12) United States Patent
Ikeda et al.

(10) Patent No.: US 6,325,368 B1
(45) Date of Patent: Dec. 4, 2001

(54) SHEET OUTPUT DEVICE AND IMAGE FORMING APPARATUS CAPABLE OF TRANSPORTING DISCHARGED SHEETS FROM MULTIPLE DISCHARGE BINS TO STACK

(75) Inventors: Hiroaki Ikeda, Toyokawa; Akinori Yoshida, Nishio; Motomi Takemoto, Toyokawa, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/414,597

(22) Filed: Oct. 8, 1999

(30) Foreign Application Priority Data

Oct. 9, 1998 (JP) ..... 10-287931

(51) Int. Cl.[7] ..... B65H 39/10; B65H 5/22

(52) U.S. Cl. ..... 271/3.03; 271/290; 270/59; 270/58.02; 399/82; 399/83

(58) Field of Search ..... 271/3.03, 3.13, 271/290, 298, 301, 302; 250/559.4; 399/82, 83; 220/58.02, 58.2, 58.21, 58.22, 59

(56) References Cited

U.S. PATENT DOCUMENTS 5,328,169 * 7/1994 Mandel ..... 271/290
5,362,200 * 11/1994 Ushirogata ..... 414/791 X
5,433,325 * 7/1995 Levaro et al. ..... 209/584 X
5,435,544 * 7/1995 Mandel ..... 271/298
5,580,039 * 12/1996 Takehara et al. ..... 270/58.11 X
5,852,764 * 12/1998 Kida et al. ..... 399/401 X
5,971,383 * 10/1999 Horikawa et al. ..... 270/58.11 X

FOREIGN PATENT DOCUMENTS 08133579 5/1996 (JP) .
09295762 11/1997 (JP) .
10059605 3/1998 (JP) .

* cited by examiner

*Primary Examiner*—David H. Bollinger
*Assistant Examiner*—Kenneth W Bower
(74) *Attorney, Agent, or Firm*—McDermott, Will & Emery

(57) ABSTRACT

A sheet output device having a stack for storing sheets and a plurality of discharge bins includes a sheet transport device for transporting a discharged sheet from a discharge bin to the stack and an indicator for indicating that the sheet has been transported by the sheet transport device, so that the user can know where the job sheet is to be output. The sheet output device further includes a memory for storing information related to a sheet output for each of the discharge bins, and the indicator indicates information related to the sheet transported by the sheet transport device.

8 Claims, 12 Drawing Sheets

FIG. 12

| PERSONAL ID NO. | BIN | DISCHARGED SHEET | JOB NAME | OUTPUT TIME | OPERATOR'S NAME |
|---|---|---|---|---|---|
| 1111 | 1 | PRESENT | aaa.txt | 10:10 | IKEDA |
| 2222 | 2 | PRESENT | bbb.txt | 12:00 | YOSHIDA |
| 3333 | 3 | PRESENT | ccc.doc | 13:02 | TAKEMOTO |
| 4444 | 4 | TRANSPORTED | ddd.xls | 12:40 | YAMADA |
| 5555 | 5 | NONE | | | |

FIG. 13

| SHEET TRANSPORTED FROM SOMEWHERE ELSE | FROM WHERE |
|---|---|
| PRESENT | BIN 4 |

FIG. 16

| | JOB NAME | OUTPUT TIME | OPERATOR'S NAME | NOTES |
|---|---|---|---|---|
| STACK | ddd.xls | 12:40 | YAMADA | FROM BIN 4 |
| BIN 1 | aaa.txt | 10:10 | IKEDA | |
| BIN 2 | bbb.txt | 12:00 | YOSHIDA | |
| BIN 3 | ccc.doc | 13:02 | TAKEMOTO | |
| BIN 4 | ddd.xls | 12:40 | YAMADA | TRANSPORTED TO STACK |
| BIN 5 | | | | |

SHEET OUTPUT DEVICE AND IMAGE FORMING APPARATUS CAPABLE OF TRANSPORTING DISCHARGED SHEETS FROM MULTIPLE DISCHARGE BINS TO STACK

This application is based on Patent Application No. 10-287931 filed in Japan, the content of which is hereby incorporated by reference.

BACKGROUND OF THE INVENTION

1. Field of the Invention

The present invention relates generally to a sheet output device and to an image forming apparatus having a combination of a copying machine, a printer, a facsimile, or a combination of these devices and a sorter. The invention more particularly relates to a sheet output device and an image forming apparatus capable of transporting discharged sheets from a plurality of discharge bins to a large capacity stack.

2. Description of the Related Art

In the field of printers, sheet output devices having a plurality of discharge bins and a stack which can store a large number of paper sheets have been used. When a number of users share a printer having such a sheet output device, a discharge bin specific to each user is allocated and registered, and if a job sheet of a registered user is output, the job sheet is discharged onto the bin allocated to the user.

The capacity of sheets which can be stored in each discharge bin (bin capacity) is however limited, and if sheets continue to be output onto a particular discharge bin and the number of the output sheets reaches the storable bin capacity of the bin, sheets can be no longer output to that particular bin. As a result, if the number of output sheets to an discharge bin reaches the maximum storable capacity or if output job sheets are left behind for a prescribed time period at a discharge bin, the job sheets which have been output to the discharge bin are transported to the stack, so that sheets can be further output to the discharge bin.

In the conventional sheet output devices, however, a job sheet could be transported to a stack under a prescribed condition, even if the user (operator) lets the job sheet output to an discharge bin registered for the user. Therefore, when the user tries to take out the job sheet, he/she sometimes cannot be sure where a job sheet has been output, and might have to take time to look around all the discharge bins and the stack.

SUMMARY OF THE INVENTION

The present invention is directed to a solution to the above-described problem, and it is an object of the present invention to provide a sheet output device and an image forming apparatus which permit the user to know where a job sheet is to be output.

In order to achieve the above-described object, a sheet output device according to one aspect of the present invention having a stack for storing paper sheets and a plurality of discharge bins includes a sheet transport device for transporting a sheet from an discharge bin to the stack and an indicator for indicating first information that a sheet has been transported by the sheet transport device.

According to another aspect of the present invention, the image forming apparatus having a stack for storing paper sheets and a plurality of discharge bins includes a sheet transport device for transporting a sheet from an discharge bin to the stack and an indicator for indicating first information that a sheet has been transported by the sheet transport device.

According to the present invention, since transporting of an output sheet from a discharge bin to the stack is indicated, a sheet output device and an image forming apparatus can be provided which permit the user to know where a sheet is to be output.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 12 is a discharge bin information management table stored in a RAM according to the embodiment;

FIG. 13 is a stack information management table stored in a RAM according to the embodiment;

FIG. 16 is a table showing the contents of the discharge bin information management table and stack information management table displayed at a liquid crystal display according to the embodiment by way of illustration.

DESCRIPTION OF THE PREFERRED EMBODIMENTS

Figure 1:
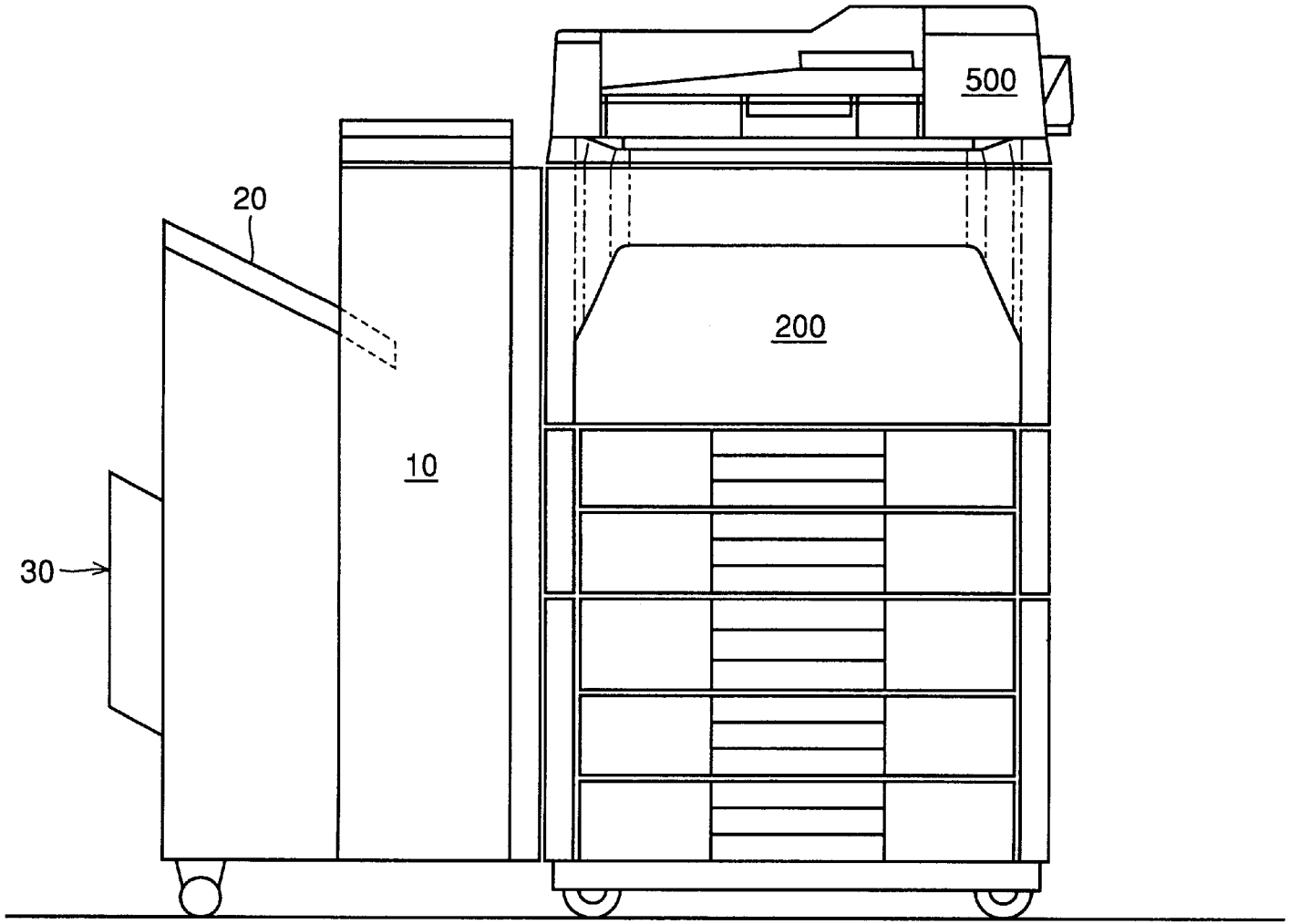
FIG. 1 is a general view of a sheet output device according to one embodiment of the present invention.

A sheet output device according to one embodiment of the present invention will be described. The sheet output device includes a staple sorter 10 and a digital copying machine 200 connected thereto. Note that the same reference characters represent the same or corresponding portions in the figures.

Referring to FIG. 1, in digital copying machine 200, an operation of the user is input through an operation panel 150 (see FIGS. 2 and 3) at the time of forming an image. In response to the input of the operation of the user, a circulating type automatic document feeder 500 placed on the top of digital copying machine 200 feeds a group of document sheets placed on a prescribed document transport tray to platen glass on a one-sheet basis. After the document is subjected to exposure process on the platen glass, document feeder 500 sequentially discharges the document from the platen glass.

Digital copying machine 200 forms an image on a paper sheet based on the image of the document read by the exposure process by electrophotography. The sheet having the image formed thereon is transported to staple sorter 10, and then discharged onto a stack 20 in staple sorter 10 which will be described or a discharge bin in a bin assembly 30.

Figure 2:
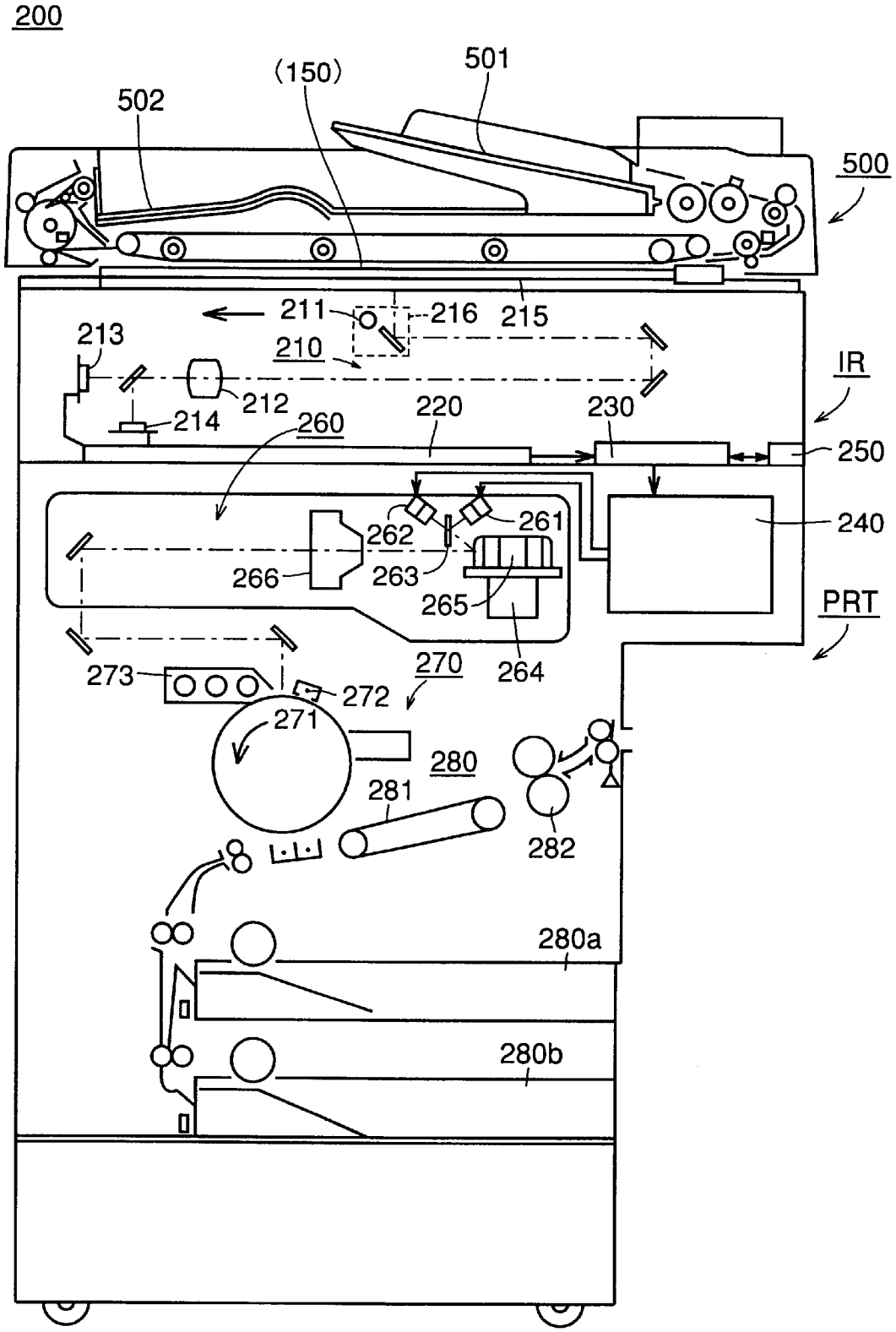
FIG. 2 is a schematic cross sectional view for use in illustration of the general construction of a digital copying machine according to the embodiment.

Referring to FIG. 2, digital copying machine 200 mainly includes automatic document feeder 500 to turn over the front and back of a document sheet as desired, an image reader IR to read an image from a document and generate image data accordingly, a memory unit portion 230 to temporarily store image data obtained by image reader IR, a printer PRT to print images on a copying sheet based on image data stored in memory unit portion 230, operation panel 150 to input operations (placed on the top of digital copying machine 200 vertically to the sheet surface of the figure), and an external input/output control portion 250 to exchange data with the outside.

In automatic document feeder 500, a document at document transport tray 501 is automatically set at a reading position on platen glass 215 from the lowermost document sheet in response to an instruction to print, and when reading by image reader IR is complete, the document is discharged onto a discharge tray 502.

Image reader IR includes a scanning system 210 and an image signal processing portion 220. In scanning system 210, the image of a document sheet set at the reading position is exposed using an exposure lamp 211 attached at a scanner 216 moving under the document. Light reflected from the document passes through a reflecting mirror and a collecting lens 212, and then input to photoelectric conversion elements 213 and 214 formed of a CCD array or the like. Then, a signal obtained by scanning system 210 is sent to image signal processing portion 220. In image signal processing portion 220, image processing such as binarizing, image quality correction, magnification-changing, and image editing. The image data after the image processing is stored in memory unit portion 230.

Printer PRT includes a printing processing portion 240, an optical system 260, an image forming system 270 and a sheet transporting system 280. Printing processing portion 240 drives optical system 260 based on image data from memory unit 230. In optical system 260, semiconductor lasers 261 and 262 emit laser beams based on signals controlled by printing processing portion 240. These beams are combined by a dichroic mirror 263, reflected by a polygon mirror rotated by a motor 264, and the resultant beam is directed to a photoreceptor drum 271 in image forming system 270 through a main lens 266.

In image forming system 270, photoreceptor drum 271 is charged with a corona charger 272, and then irradiated with a laser beam from optical system 260. Thus, a latent electrostatic image is formed on photoreceptor drum 271. Then, a developer 273 applies toner on the latent electrostatic image. The toner image on photoreceptor drum 271 is transferred onto a copying sheet fed from a feeding cassette 280*a* or 280*b* in paper feeding system 280. The sheet is then transported to a fixing device 282 by a sheet transport belt 281, the toner fixed on the sheet under the heat and pressure, and then the resultant sheet is discharged onto a receiving roller pair 81 at staple sorter 10 (see FIG. 4) connected to digital copying machine 200.

External input/output portion 250 exchanges data between a personal computer connected to the outside, a local area network (LAN) and a public switched telephone network (PSTN) and memory unit 230. External input/output control portion 250 mainly includes a communication control portion to control communication for exchanging a control signal and image data with the personal computer, a network control portion connected to the LAN to control network for exchanging a control signal and image data with an external device connected to the LAN, a facsimile converting portion to exchange data with memory unit portion 230 and convert image density and coding method in a facsimile operation, and a G3 unit to control communication such as modulation and demodulation of image data and a control signal in a facsimile operation and connected to a telephone line to control communication with the PSTN.

Figure 3:
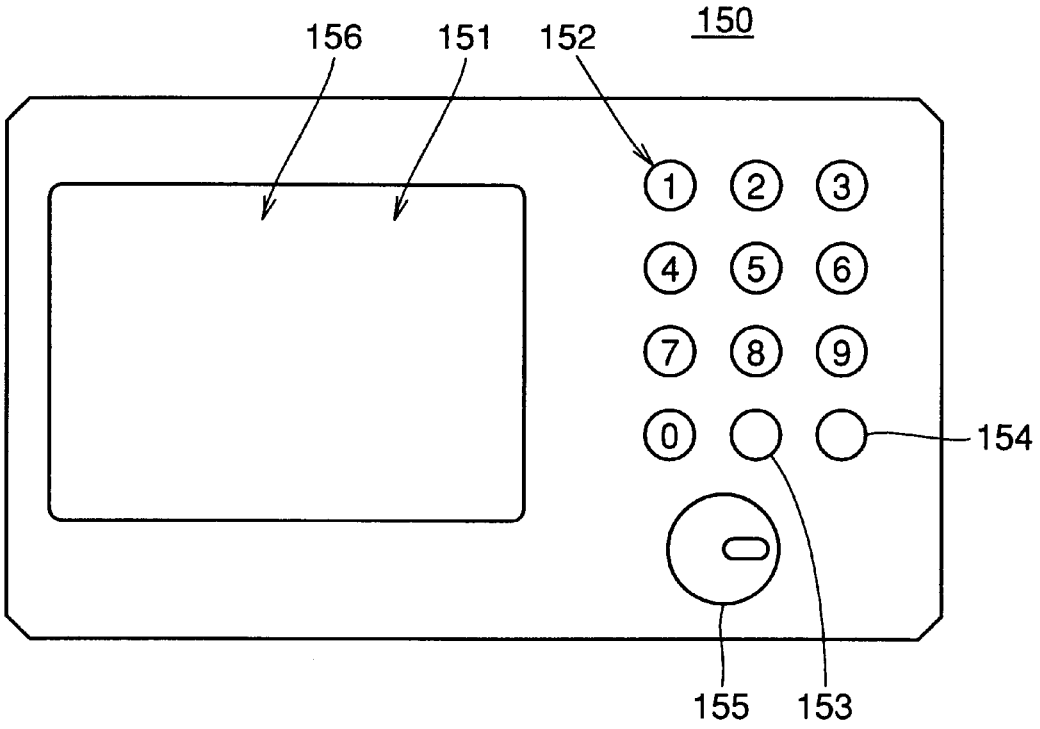
FIG. 3 is a plan view of an operation panel provided on the top surface of the digital copying machine according to the embodiment.

Referring to FIG. 3, operation panel 150 includes a liquid crystal display 156 and a touch panel 151 provided thereon and formed of a transparent member. Liquid crystal display 156 displays the state of a job sheet output to the stack and a discharge bin which will be described, in addition to copying conditions for digital copying machine 200 and its internal state. Touch panel 151 is used to set a copying condition, and the user may input a prescribed operation using the touch panel. Operation panel 150 further includes a numeral keys 152 used to input numerical values such as the number of copies and magnification, a reset key 153 to reset a copying condition set by the user's input, a switch key 154 to switch the image displayed on the screen of liquid crystal display 156, and a start key 155 to instruct the start of a copying operation.

The internal construction of staple sorter 10 will be now described.

Figure 4:
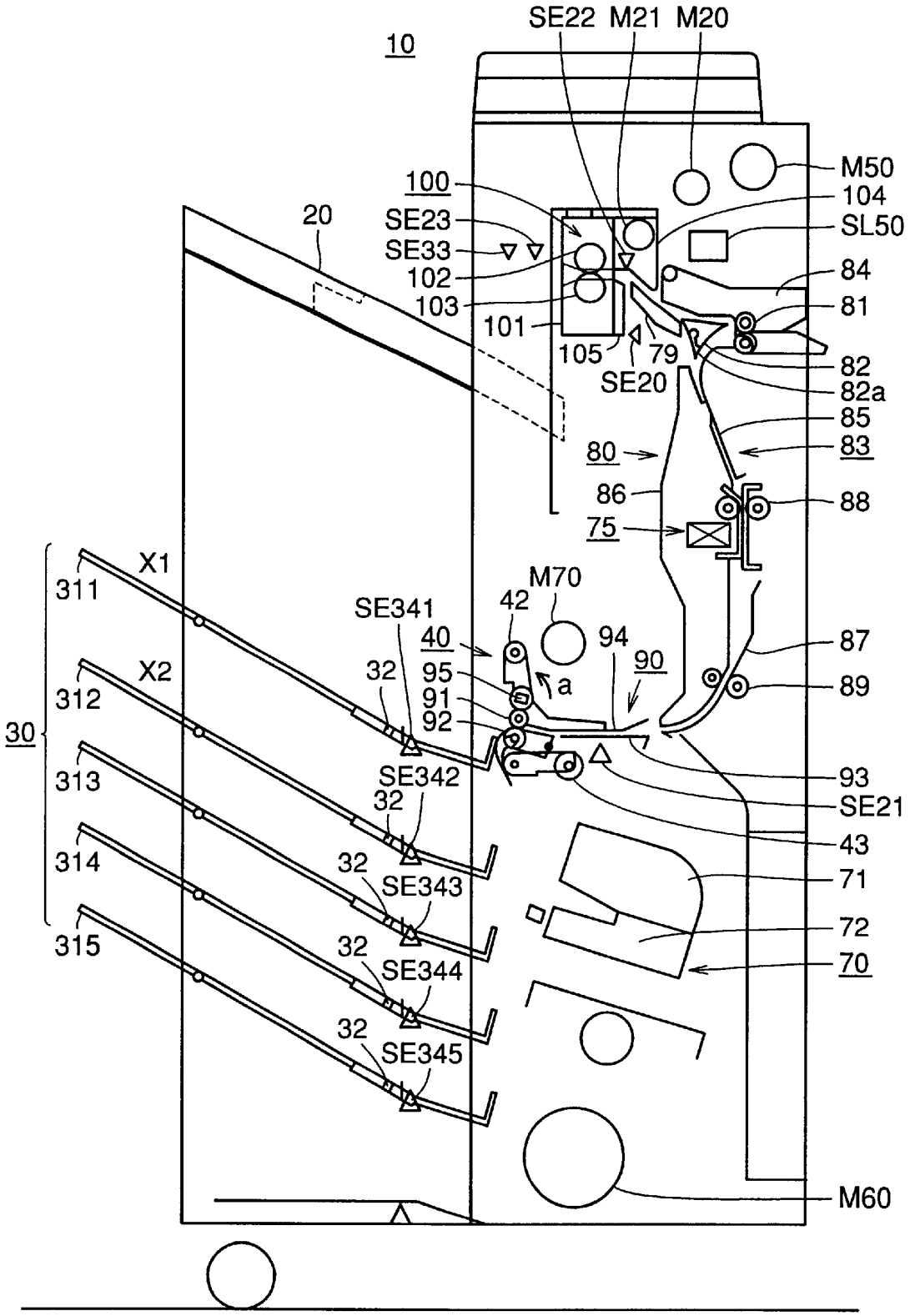
FIG. 4 is a view for use in illustration of the construction of a staple sorter according to the embodiment.

Referring to FIG. 4, staple sorter 10 mainly includes a sheet transport device portion 80, a bin assembly 30 having five stages of discharge bins 311 to 315 (hereinafter as discharge bins 311 to 315), a staple unit 70 to subject a set of sheets to a stapling process, a take out unit 40 driven by a motor M70 to present a set of sheets taken from discharge bins 311 to 315 to a sheet set transport gate 100, a stack 20, and sheet set transport gate 100 to transport a set of sheets taken from discharge bins 311 to 315 by take out unit 40 onto stack 20.

Referring to FIG. 4, elements such as sheet transport device portion 80, bin assembly 30, staple unit 70 and sheet set transport gate 100 will be now particularly described.

Sheet transport device portion 80 includes receiving roller pair 81 to receive sheets discharged from digital copying machine 200, a first transport portion 83 to transport a sheet virtually vertically, a switch claw 82 to switch the direction of transporting sheets between the sides of first transport portion 83 and sheet set transport gate 100, and a second transport portion 90 to transport sheets virtually horizontally to the side of bin assembly 30 from first transport portion 83.

Switch claw 82 can rotate around a spindle 82*a* based on the on and off of a solenoid SL50.

When solenoid SL50 is off, switch claw 82 is set at a position shown in FIG. 4. At this time, a sheet discharged from digital copying machine 200 and received by receiving pair 81 is guided by the curved, right side surface of switch claw 82 and transported into first transport portion 83.

When solenoid SL50 is on, switch claw 82 rotates clockwise from the position shown in FIG. 4. At this time, a sheet discharged from digital copying machine 200 and received by receiving roller pair 81 is guided by the upper surface of switch claw 82 and a guide plate 79, and transported onto stack 20 through sheet set transport gate 100 which will be described.

First transport portion 83 includes guide plates 84 to 87 to guide a sheet and transport roller pairs 88 and 89 to transport a sheet, and there is provided a punch unit 75 at an intermediate stage portion to form binding holes at the head or tail end of sheets in the direction of transport. Second transport portion 90 includes transport rollers 91 and 92 to transport sheets, guide plates 93 and 94 to guide sheets. Guide plate 94 is attached at a side plate portion of guide plate 93 and transport roller 91 is mounted at one end of guide plate 94. Second transport portion 90 can be turned in the direction denoted by arrow a at about 90° around spindle 95 from the position shown in FIG. 4.

In staple sorter 10, when sheets are distributed to discharge bins 311 to 315, second transport portion 90 is at the position shown in FIG. 4, and a sheet transported by transport rollers 91 and 92 is transported to the side of bin assembly side 30. When a set of sheets are taken from discharge bins 311 to 315 and set onto the stack, second transport portion 90 turns around spindle 95 in the direction denoted by arrow a at about 90° and is withdrawn from the sheet transport position.

Second transport portion 90 includes a sensor SE21 which detects a set of sheets stored/taken out in/from discharge bins 311 to 315.

Receiving roller pair 81, transport pairs 88 and 89, transport rollers 91 and 92, take out rollers 42 and 43 are rotated through a driving force transmitting portion (not shown) by motor M50. Take out rollers 42 and 43 are provided in take out unit 40, hold a set of sheets taken from discharge bins 311 to 315 and present the set of sheets to gate 100.

Bin assembly 30 will be now described. Bin assembly 30 is formed the five stages of discharge bins 311 to 315, which are provided inclined at prescribed intervals. Pins 32 provided at the lower end side of discharge bins 311 to 315 are each engaged with a spiral groove formed at the outer circumferential surface of a driving shaft (not shown) provided in the vertical direction, and the driving shaft is normally/reversely rotated to raise/lower bins 311 to 315.

Bin assembly 30 is set at its home position in FIG. 4. At this home position, first discharge bin 311 opposes transport rollers 91 and 92, while second discharge bin 312 opposes staple unit 70. Hereinafter, the position of discharge bins 311 to 315 opposing to transport rollers 91 and 92 is referred to as position X1, while the position of discharge bins opposing staple unit 70 is referred to as position X2.

If the driving shaft is reversely rotated once from the state in which first discharge bin 311 is at position X1, first discharge bin 311 is lowered to position X2, and second discharge bin 312 is lowered to a position in contact with third discharge bin 313. When first discharge bin 311 is at position X2, a set of sheets on first discharge bin 311 can be bound using staple unit 70. Once the set of sheets is bound, rotating the driving shaft once in the normal direction causes first discharge bin 311 to rise to position X1 again and second discharge bin 312 to position X2.

There are provided at bin assembly 30 a sensor (not shown) to detect discharge bins 311 to 315 being set at the home position and a sensor (not shown) to detect discharge bins 311 to 315 having been raised for one pitch by one rotation of the driving shaft. Sensors SE341 to SE345 to detect the presence/absence of a sheet are attached to discharge bins 311 to 315.

Staple unit 70 will be now described. Staple unit 70 has a well-known electric construction, and includes a head portion 71 which can attach/detach a cartridge having staples inside and an anvil portion 72 to receive and bend a staple let out from head portion 71. Staple unit 70 moves to the side of discharge bins 311 to 315 set at position X2, and a staple(s) is inserted at one position at a corner of a set of sheets or at two positions at an end of the set of sheets.

More specifically, staple unit 70 can move toward the back side of staple sorter 10 as the front side (the front side in the sheet of the figure) is the home position, stops at a prescribed position, moves to the side of discharge bins 311 to 315 for inserting a staple, and then returns to the home position after inserting the staple. Note that an incision is formed at a position corresponding the insertion of the staple at the lower end of discharge bins 311 to 315, and the tip end of staple unit 70 may come into the side of discharge bins 311 to 315.

Sheet set transport gate 100 will be now described. Sheet set transport gate 100 includes a pair of gate rollers 102 and 103, sheet guide plates 104 and 105 in a box 101, and rollers 102 and 103 are normally/reversely rotated by a motor M21. Sheet set transport gate 100 is raised/lowered as it is guided by a guide member (not shown) and has a motor M20 as a driving force.

Sheet set transport gate 100 is at its home position in FIG. 4. At this home position, a sheet guided onto the upper surface of switch claw 82 from receiving roller pair 81 is transported to the left in FIG. 4 by the rotation of rollers 102 and 103 and transported onto stack 20.

How a set of sheets on discharge bin 312 is transported onto stack 20 will be now described. Sheet set transport gate 100 can move within staple sorter 10 as shown in FIGS. 5 to 10.

Figure 5:
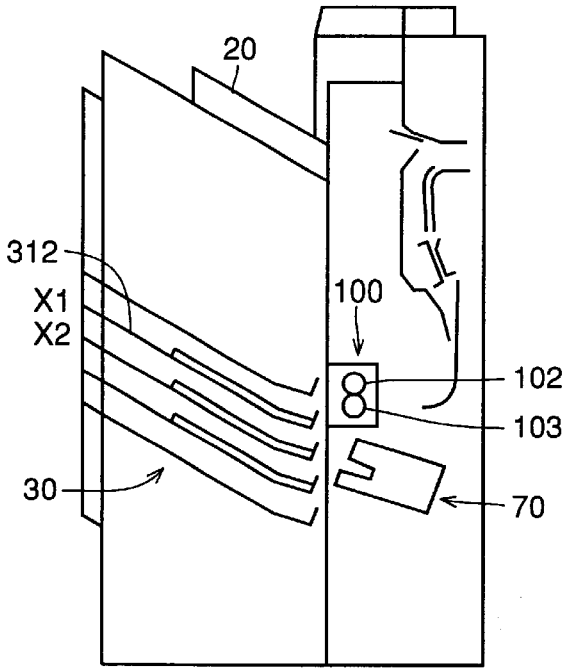
FIGS. 5 to 10 are first to sixth views for use in illustration of the movement of a sheet set transport gate in the staple sorter according to the embodiment.
Figure 6:
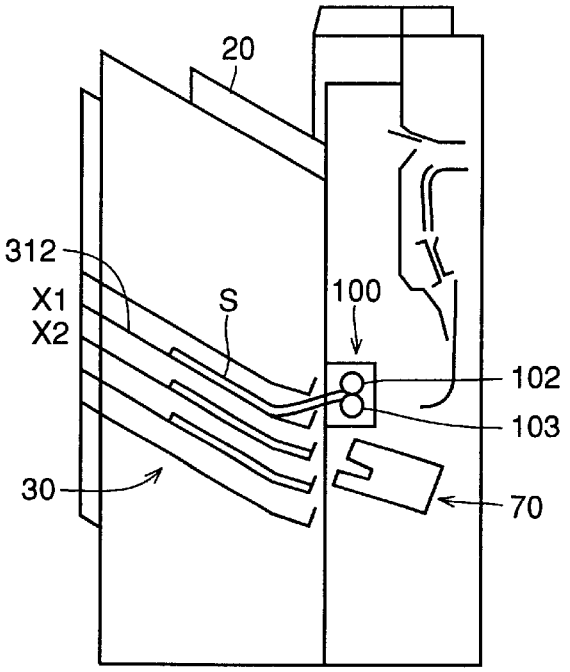
Figure 7:
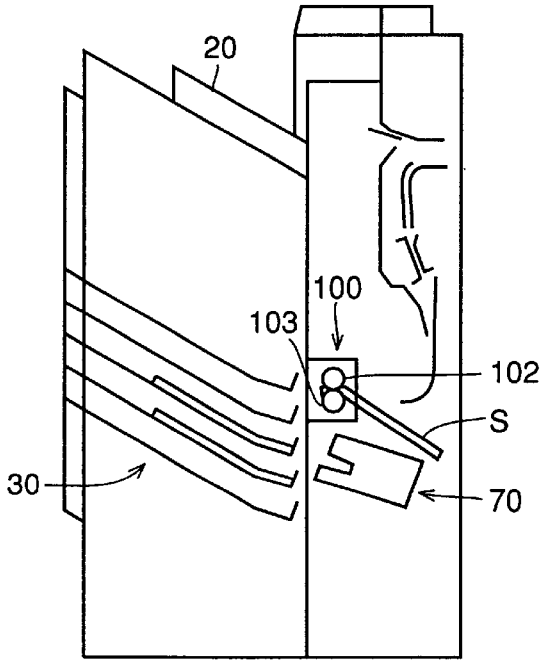

Sheet set transport gate is lowered to a position corresponding discharge bin 312 set at position X1 in order to receive a stapled or non-stapled, sheet set on discharge bin 312 (see FIG. 5). At this position, sheet set S which has been taken from discharge bin 312 by the movement of take out rollers 42 and 43 in FIG. 4 is held at sheet set transport gate 100 between rollers 102 and 103 (see FIG. 6). Sheet set S is taken into sheet set transport gate 100 by normally rotating rollers 102 and 103 (see FIG. 7).

Figure 8:
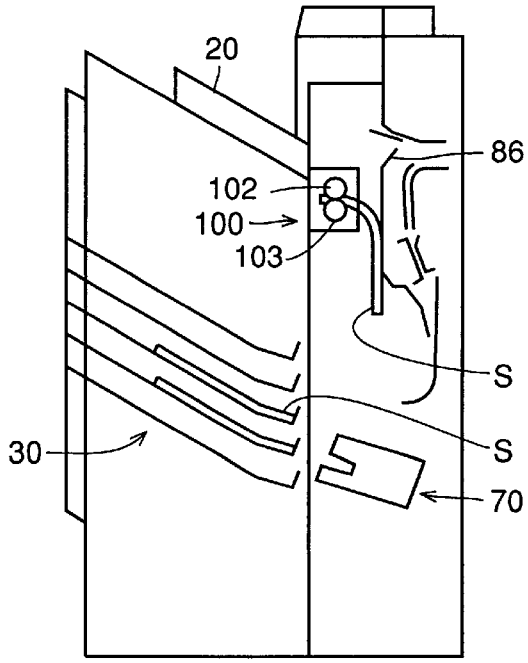
Figure 9:
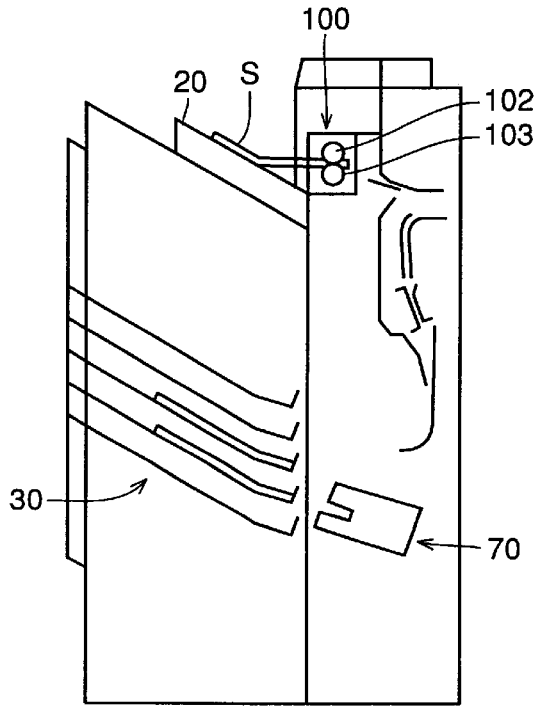
Figure 10:
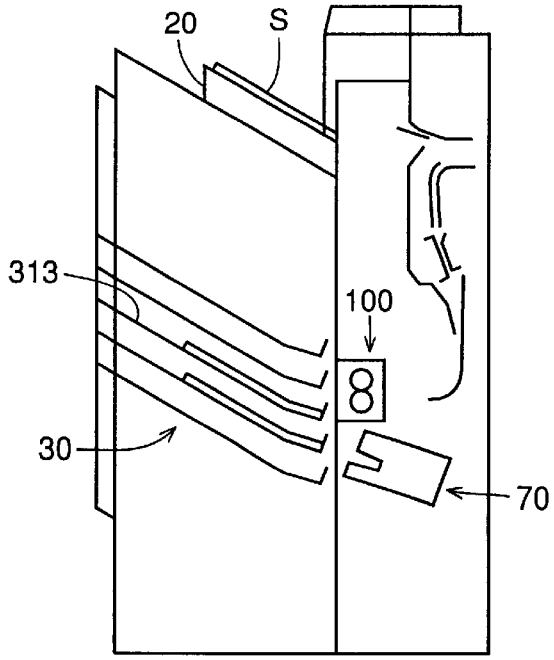

Once sheet set S is completely taken into sheet set transport gate 100, the normal rotation of rollers 102 and 103 is stopped, and sheet set transport gate 100 is raised at the same time (see FIG. 8). Once sheet set transport gate 100 rises to a prescribed level, rollers 102 and 103 reversely rotate to discharge sheet set S held between rollers 102 and 103 onto stack 20 (see FIG. 9).

Sheet set transport gate 100 is lowered to a transport position opposing to discharge bin 313 raised for 1 pitch and set at position X1 (see FIG. 10), and the stacking operation to stack 20 as described above may be repeated.

In order to achieve the stacking operation, as shown in FIG. 4, there are provided at the upper part of stack 20, a sensor SE33 to detect the presence/absence of a sheet on stack 20, and a sensor SE23 to detect the uppermost surface of the sheets on stack 20 (if there is no sheet, the upper surface of stack 20). There are also provided a sensor SE20 to detect sheet set transport gate 100 being at the home position and a sensor SE22 to detect the presence/absence of a set of sheets in sheet set transport gate 100.

Note that in staple sorter 10, the stacking operation may be performed in parallel with a staple process to a set of sheets on a discharge bin set at position X2.

In the sheet output device having this construction, if discharge bins 311 to 315 are pre-allocated for each of a plurality of users, a job sheet will be output to a discharge bin allocated to a user in response to an instruction from the user to output the job sheet.

Figure 11:
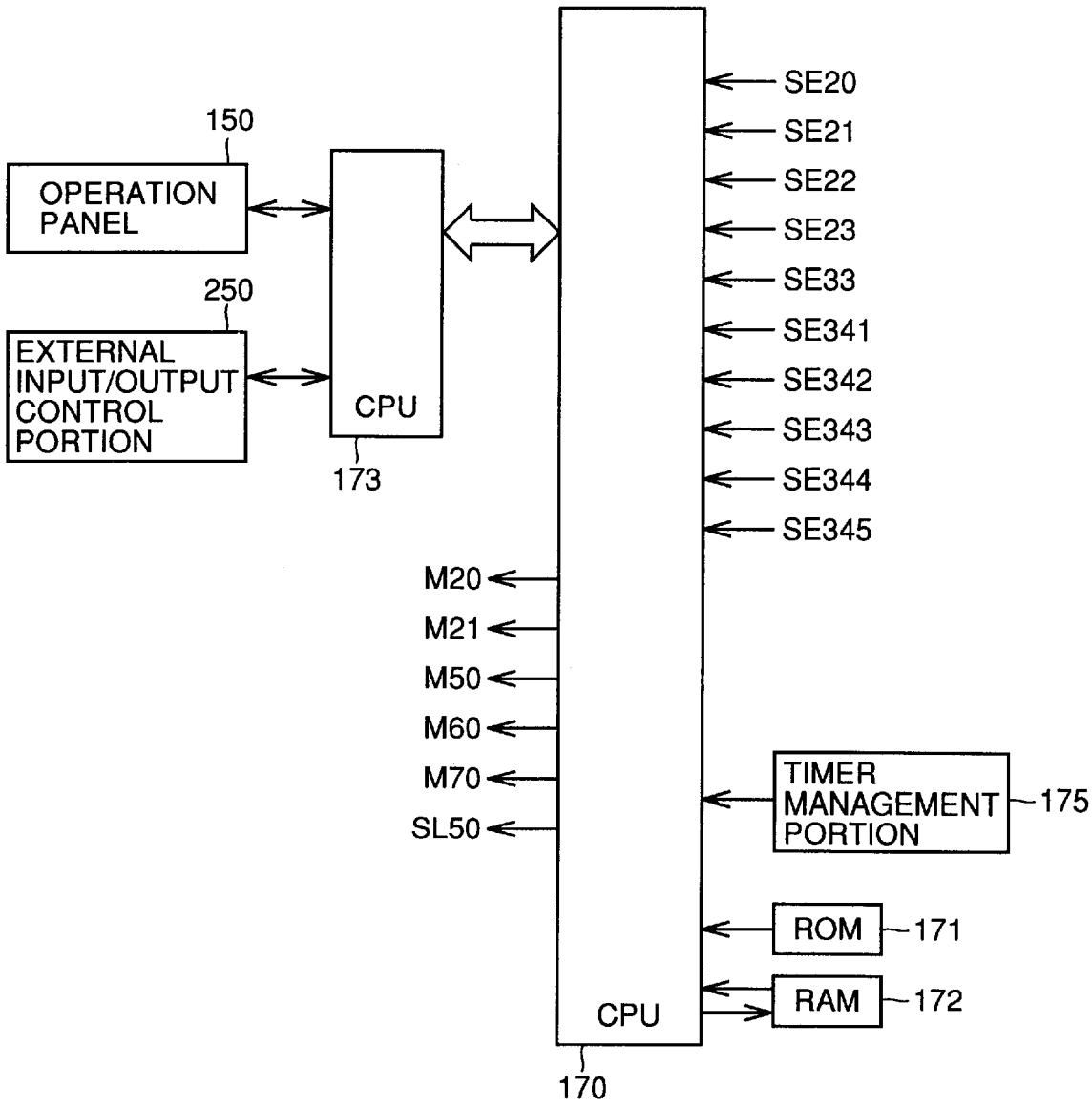
FIG. 11 is a block diagram showing the configuration of a control portion which controls the digital copying machine and stable sorter according to the embodiment.

Digital copying machine 200 and staple sorter 10 described above are controlled by a control portion shown in FIG. 11.

Referring to FIG. 11, the control portion includes a ROM 171 to store programs to operate staple sorter 10, a CPU to execute the programs, a RAM 172 to store information necessary for executing the programs, and a CPU 173 to control digital copying machine 200.

CPU 170 is provided with detection signals from sensor SE20 to detect sheet set transport gate 100 being at the home position, sensor SE21 to detect the presence/absence of a set of sheets at second transport portion 90, a sensor SE22 to detect the presence/absence of a set of sheets within sheet set transport gate 100, a sensor SE23 to detect the uppermost surface of a sheet on stack 20, a sensor SE33 to detect the presence/absence of a sheet on stack 20, and sensors SE341 to SE345 to detect the presence/absence of a sheet on discharge bins 311 to 315, the elements described in conjunction with FIG. 4.

CPU 170 transmits driving signals to motor M20 to raise/lower sheet set transport gate 100, motor M21 to rotate rollers 102 and 103 in sheet set transport gate 100, a motor M50 to drive various rollers in staple sorter 10, a motor M60 to drive the driving shaft for raising/lowering discharge bins 311 t 315, a motor M70 to drive take out unit 40, and a solenoid SL50 to drive switch claw 82 for switching the direction of transporting sheets.

CPU 170 is connected to a timer management portion 175. Timer management portion 175 manages time for each of discharge bins 311 to 315 by counting time during which each discharge bin has been left behind after a job sheet is output to the discharge bin.

A CPU 173 is connected to image reader IR, memory unit portion 230, printer PRT, external input/output control portion 250 and operation panel 150 in digital copying machine 200. CPUs 170 and 173 are connected, a signal to request the start of printing process is transmitted from CPU 170 to CPU 173, while a signal indicating the end of printing process is transmitted from CPU 173 to 170, and the timing of printing an image onto a sheet in digital copying machine 200 is adjusted as processing at staple sorter 10 is performed.

RAM 172 stores a discharge bin information management table and a stack information management table.

Referring to FIG. 12, items in the discharge bin information management table stored in RAM 172 will be now described. Bins 1 to 5 in the discharge bin information management table correspond to discharge bins 311 to 315 described above (see FIG. 4). It is detected if a sheet being discharged on discharge bins 311 to 315 by sensors SE341 to SE345, and "present" and "absent" in item "discharged sheet" represent the result of detection.

The item "transported" represents the transport of a job sheet from a discharge bin to the stack. The item "personal identification number" corresponds to bins 1 to 5, and is pre-registered by input through operation panel 150. The item "job name" represents the name of a job instructed to be output. The item "output time" represents time at which an output job indicated at the item "job name" is output to discharge bins 311 to 315. The item "operator's name" represents the name of a person who instructed output of an output job indicated at the item "job name".

Note that "output time" may be the time at the end of the output of a job sheet to a discharge bin, counted based on the number of job sheets to be output.

Referring to FIG. 13, the stack information management table stored in RAM 172 is a management table to indicate whether or not a job sheet which has been transported from discharge bins 311 to 315 is present on the stack, and if any, which discharge bin the job sheet has been transported from. The item "sheet transported from somewhere else" indicates the presence/absence of a job sheet which has been transported from any of discharge bins 311 to 315, and "present" is indicated if there is a job sheet which has been transported from somewhere, and otherwise "absent" is indicated. The item "from where" indicates which discharge bin a job sheet has transported from, using the number of the discharge bin if there is such a job sheet which has been transported to the stack from any of discharge bins 311 to 315. Note that if there are a number of job sheets on the stack which have transported from discharge bins 311 to 315, the number of pieces of data on job sheets (the number of rows) stored in the stack information management table increases.

The process of outputting a sheet performed at the sheet output device according to the present embodiment will be now described.

Figure 14:
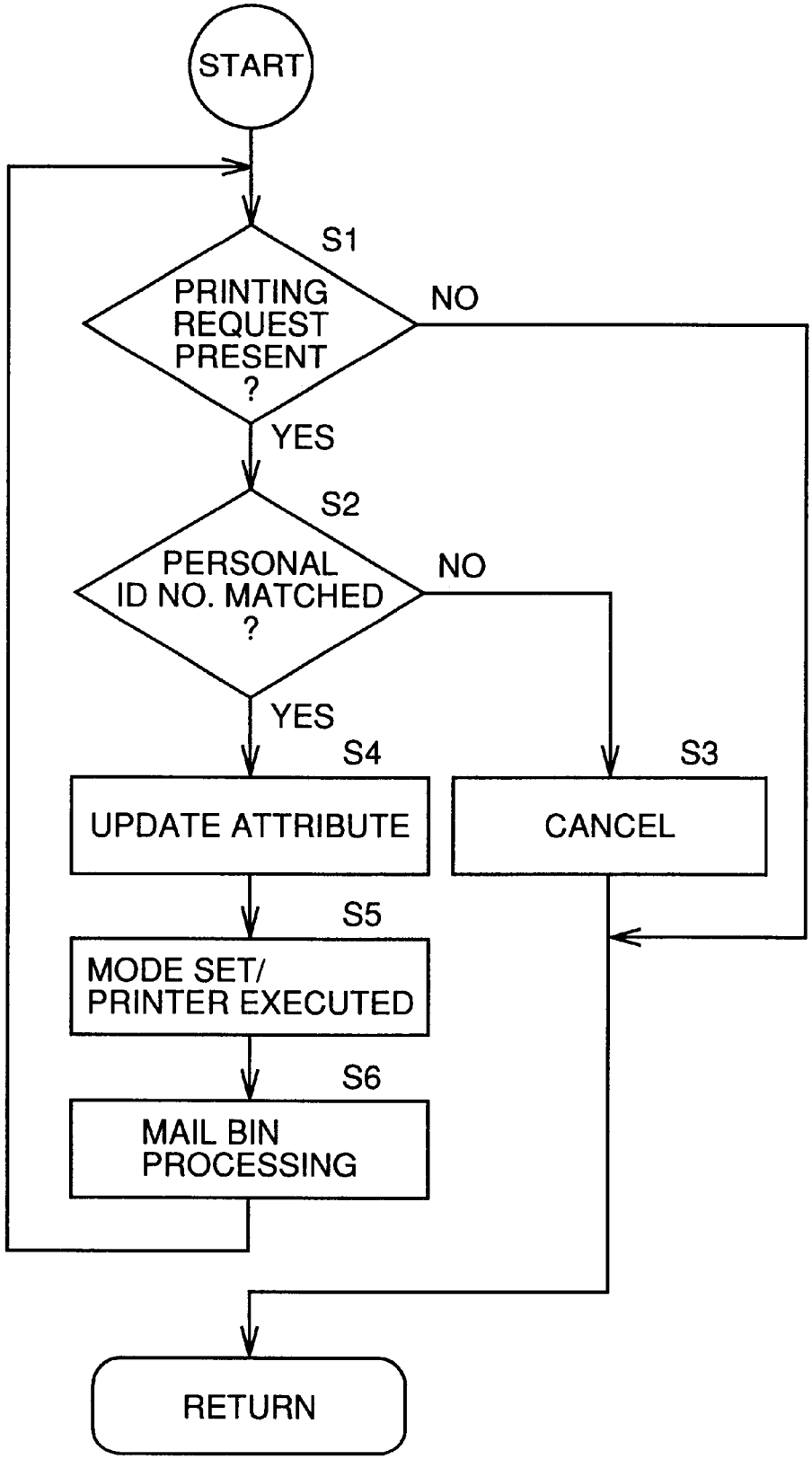
FIG. 14 is a flow chart showing the flow of sheet output processing according to the embodiment.

Referring to FIG. 14, when a program is started in response to turning on of a power supply, the sheet output device determines the presence/absence of a printing request in step S1. The printing request is obtained through external input/output control portion 250 when an external personal computer is connected. When the user directly operates digital copying machine 200, such a printing request is detected based on pressing of a start key 155 on operation panel 150. If there is no printing request (NO in step S1), the process is completed, and otherwise (YES in step S1), the personal identification number is verified.

If there is an external personal computer connected, and the personal computer provides an output instruction, the personal identification number is acquired from the personal computer. If the operator directly operates digital copying machine 200, the personal identification number is input from numeral keys 152 on operation panel 150. The personal identification number is pre-registered in the discharge bin management table. It is determined if the personal identification number obtained from external input/output control portion 250 or operation panel 150 is correct by searching the discharge bin information management table.

If the personal identification number obtained in step S2 is not in coincidence with a personal identification number stored in the discharge bin information management table (NO instep S2), the printing request is cancelled (step S3). If there is a printing request from an external personal computer, a cancel signal is transmitted through external input/output control portion 250, and if the operator directly operates digital copying machine 200, "not registered personal identification number" is indicated on liquid crystal display 156 at operation panel 150.

If a personal identification number in coincidence with the personal identification number obtained in step S2 is registered in the discharge bin information management table (YES in step S2), the number of a corresponding discharge bin is obtained, and a "job name", "output time" and "operator's name" are written in the discharge bin information management table (step S4).

If an external personal computer or the like is connected, the "job name" and "operator's name" are those obtained from the personal computer through external input/output control portion 250, or if the operator directly operates digital copying machine 200, a "job name" and "operator's name" are input from touch panel 151 at operation panel 150. If such "job name" and "operator's name" are not available, the writing operation to the discharge bin information management table may be omitted.

The "output time" indicates the time at which a job instructed to be output is output to a discharge bin or the time at which output of a job sheet to a discharge bin ends, counted based on the number of job sheets or the like.

When the discharge bin information management table has been updated, a mode such as copying conditions for copying machine 200 is set and a printing executing command is transmitted, thus starting printing (step S5). A sheet printed with data by digital copying machine 200 is transported to staple sorter 10, at which mail bin process such as discharge to a discharge bin or transport to the stack is performed. Thereafter, the control returns to step S1, and the process from steps S1 to S6 is repeated.

Figure 15:
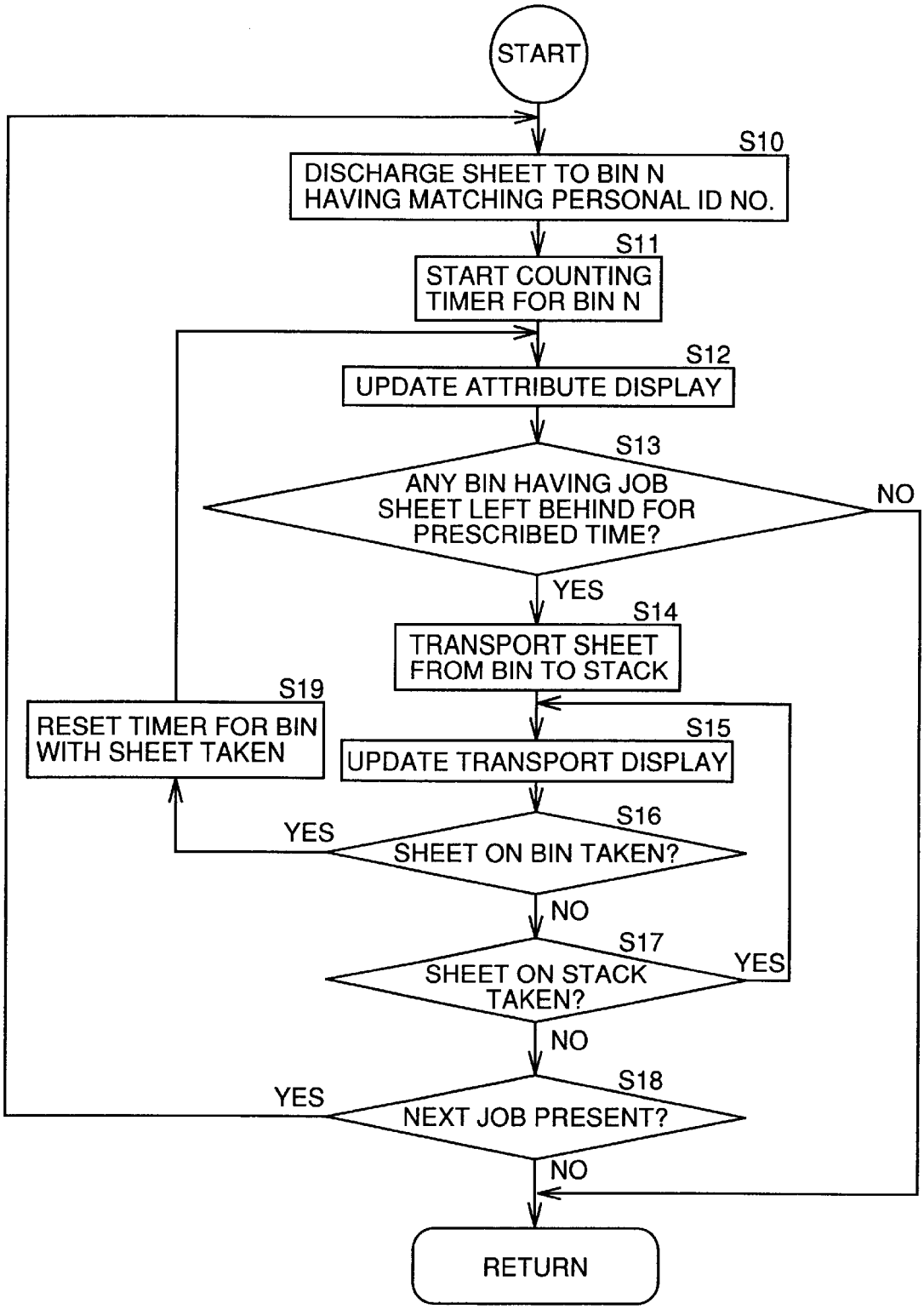
FIG. 15 is a flow chart showing the flow of mail bin processing according to the embodiment.

The mail bin process will be now described. Referring to FIG. 15, in the mail bin process, a personal identification number obtained in step S2 in FIG. 14 and a personal identification number in the discharge bin information management table stored in RAM 172 are compared, a discharge bin having a matching personal identification number is selected, and a sheet printed by digital copying machine 200 is output to the selected discharge bin (step S10). Then, timer management portion 175 starts a timer corresponding to the selected discharge bin (step S11).

Then, the updated content of the discharge bin information management table stored in RAM 172 is displayed on the liquid crystal display portion 156 at operation panel 150 (step S12).

Among the timers for discharge bins counting, the presence/absence of a discharge bin having a job sheet left behind for a prescribed time period is determined in timer management portion 175 (step S13). If there is no such discharge bin, the corresponding timer of which has passed the prescribed time period, the mail bin process is completed and the control returns to the sheet output process. Otherwise, sheet set transport gate 100 is driven and a job sheet discharged to the discharge bin the corresponding timer of which has passed the prescribed time period is transported to the stack (step S14).

As a job sheet output to the discharge bin the corresponding timer of which has passed the prescribed time period is transported to the stack, the discharge bin information management table and stack information management table stored in RAM 172 are updated and displayed at liquid crystal display portion 156 (step S15).

Then, based on detection signals from sensors SE341 to SE345, it is determined if a job sheet discharged to discharge bins 311 to 315 has been taken out (step S16). If the job sheet has been taken out, a timer corresponding to the discharge bin from which the sheet has been taken out is reset (step S19), and then the discharge bin information management table is updated (step S12). In the updating at this time, data corresponding to the discharge bin from which the sheet has been taken out is labeled "none" at the item "discharged sheet", and data at the "job name", "output time" and "operator's name" is cleared.

If a job sheet discharged to a discharge bin has not been taken out (NO in step S16), it is determined if a job sheet on the stack has been taken out based on the output of sensor SE23 (step S17). If a job sheet has been output, the discharge bin information management table and stack information management table are updated, and the content of the discharged discharge bin information management table and stack information management table is displayed at liquid crystal display portion 156 (step S15). In the updating of the stack information management table, the data is entirely cleared, and in the updating of the discharge bin information management table, data corresponding to "from where" in the cleared data at the "discharged sheet" is updated into "none", and data at the "job name", "output time", and "operator's name" is cleared.

When a job sheet on a stack has not been taken out (NO in step S17), the presence/absence of the next output job is determined (step S18). If there is an output job, the control proceeds to step S10, and the above-described process is repeated. If there is no output job (NO in step S18), the mail bin process is completed, thus returning to the sheet output process.

Herein, an example of display at liquid crystal display portion 156 showing the content of the discharge bin management table and stack management table is given. Referring to FIG. 16, for each of the stack and the first to fifth discharge bins, "job name", "output time", "operator's name", "notes" are indicated. For example, according to the indication, a job sheet for a job under the name of "ddd.xls" output by "Yamada" at "12:40" is placed at the stack, and the job sheet has been transported from the fourth discharge bin. Meanwhile, the same content as that displayed for the column of the stack is indicated for "job name", "output time" and "operator's name", and "transported to stack" is indicated in "notes", thus showing "ddd.xls" output to the fourth discharge bin has transported to the stack.

Note that if there are a plurality of pieces of data stored in the stack information management table, a plurality of lines of information are displayed.

As described above, in the sheet output device according to the present invention, what kind of job has been output by who and when is displayed at liquid crystal display portion 156, and therefore the user may easily know where a job sheet, output of which he/she has instructed, is located. If a job sheet output to a discharge bin is transported to the stack after the elapse of time, for which job the job sheet thus transported to the stack has been output and from which discharge bin the sheet has been transported are displayed at liquid display portion 156, so that the user can easily know at which discharge bin the job sheet, output of which he/she has instructed, is located.

In the sheet output device as described above, the content of the discharge bin information management table and stack information management table is displayed on operation panel 150 at liquid display device 156, and a modification of the above will be now described.

First Modification

According to a first modification, immediately before or after the transport of a job sheet from a discharge bin to the stack, the content of the discharge bin information management table and stack information management table shown in FIG. 16 (hereinafter as "display information") is printed onto a new sheet by digital copying machine 200, and the sheet having the printed display information is discharged to the stack.

According to the first modification, the sheets printed with the display information is discharged on the top or bottom of the set of job sheets transported to the stack. As a result, the user may view the sheet printed with display information, discharged to the stack and be easily informed of the location of the job sheet he/she has output.

Second Modification

According to a second modification, when an output instruction is given from an externally connected personal computer or the like, display information is transmitted to the personal computer or the like through external input/output control portion 250.

Thus, the user who has instructed output through the personal computer may be informed of where a job sheet he/she has thus output by the computer before going to the sheet output device to take out the job sheet.

Third Modification

According to a third modification, an audio sound synthesizing device and an audio sound output device are connected to CPU 173, and the user is informed of the transport of a job sheet from a discharge bin to the stack by an audio sound.

If for example the content of the discharge bin information management table is as shown in FIG. 12, and the content of the stack information management table is as shown in FIG. 13, the person who outputs the job, in other words, the operator presses switch key 154 at operation panel 150 in the sheet output device, "the job sheet of Yamada at the fourth discharge bin has been transported to the stack" is output in audio sound.

According to the third modification, the user may press switch key 154 to be informed of which discharge bin a job sheet transported to the stack has been transported from by audio sound, and therefore he/she may know if the job sheet he/she output is located in the stack or a discharge bin by the audio sound.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A sheet output device having a stack for storing sheets and a plurality of discharge bins, comprising:

a sheet transport device to transport a sheet from said discharge bin to said stack;

a generation device to generate first information showing that the sheet has been transported by said sheet transport device; and an indicator to indicate the first information generated by said generation device to a user.

2. The sheet output device according to claim 1, further comprising, a memory to store information related to a sheet discharged to said discharge bin on a discharge bin basis, wherein said indicator also indicates second information related to the sheet transported by said sheet transport device.

3. The sheet output device according to claim 1, wherein said indicator includes a display to display said first information.

4. A sheet output device having a stack for storing sheets and a plurality of discharge bins, comprising:

a sheet transport device to transport a sheet from said discharge bin to said stack;

and an indicator to indicate first information that the sheet has been transported by said sheet transport device wherein said indicator includes a printer to print said first information.

5. An image forming apparatus having a stack for storing sheets and a plurality of discharge bins, comprising:

a sheet transport device to transport a sheet from said discharge bin to said stack;

a generation device to generate first information showing that the sheet has been transported by said sheet transport device; and an indicator to indicate the first information generated by said generation device to a user.

6. The image forming apparatus according to claim 5, further comprising a memory to store information related to a sheet discharged to said discharged bin on a discharge bin basis, wherein said indicator also indicates second information related to the sheet transported by said sheet transport device.

7. The image forming apparatus according to claim 5, wherein said indicator includes a display to display said first information.

8. An image forming apparatus having a stack for storing sheets and a plurality of discharge bins, comprising:

a sheet transport device to transport a sheet from said discharge bin to said stack; and an indicator to indicate first that a sheet has been transported by said sheet transport device, wherein said indicator includes a printer to print said first information.

* * * * *